US006114933A

United States Patent [19]

Widiger et al.

[11] Patent Number: 6,114,933

[45] Date of Patent: Sep. 5, 2000

[54] PENCIL IGNITION COIL ASSEMBLY MODULE ENVIRONMENTAL SHIELD

[75] Inventors: Alex William Widiger, Canton; Gregg Michael Stefansky; Todd Christopher Sexton, both of Brighton; William Douglas Walker, Saline, all of Mich.

[73] Assignee: Visteon Global Technologies, Inc., Dearborn, Mich.

[21] Appl. No.: 09/391,571

[22] Filed: Sep. 8, 1999

[51] Int. Cl.[7] ..... H01F 27/02; H01F 27/29

[52] U.S. Cl. ..... 336/96; 336/90; 336/92; 336/192

[58] Field of Search ..... 336/90, 96, 192, 336/198; 439/848

[56] References Cited

U.S. PATENT DOCUMENTS

| | | | |
|---|---|---|---|
| 4,514,712 | 4/1985 | McDougal | 336/96 |
| 5,128,646 | 7/1992 | Suzuki et al. | 336/110 |
| 5,590,637 | 1/1997 | Motodate | 123/634 |
| 5,736,917 | 4/1998 | Kawano et al. | 336/90 |
| 5,764,124 | 9/1998 | Nakamichi et al. | 336/92 |
| 5,870,012 | 2/1999 | Sakamaki et al. | 336/107 |
| 5,949,319 | 9/1999 | Nuebel et al. | 336/96 |

FOREIGN PATENT DOCUMENTS 2 199 193 6/1988 United Kingdom .

*Primary Examiner*—Michael L. Gellner
*Assistant Examiner*—Anh Mai
*Attorney, Agent, or Firm*—Mark L. Mollon

[57] ABSTRACT

An ignition coil assembly module (40) that can be connected to and disconnected from an engine spark plug. The module elements are arranged as a succession of cylindrical layers about a central ferromagnetic core (46). From innermost to outermost, the succession is: a) a secondary bobbin (48), b) a secondary coil (58), c) a secondary encapsulant (194) encapsulating the secondary coil, d) a primary bobbin (50), e) a primary coil (56), f) an inner wall (181) of an environmental shield (42) encapsulating the primary coil, g) a ferromagnetic shell (52), and h) an outer wall (180) of the environmental shield encapsulating the shell. The primary bobbin forms a liquid container for holding secondary coil encapsulant. A terminal (100) extends through a transverse wall (71) of the primary bobbin for carrying secondary current from the secondary coil to another terminal (118) on the other side of the transverse wall that connects to a spark plug (80). The two terminals are connected together by a mechanical locking connection that keeps them together when the module is disconnected from the spark plug.

17 Claims, 8 Drawing Sheets

PENCIL IGNITION COIL ASSEMBLY MODULE ENVIRONMENTAL SHIELD

REFERENCE TO RELATED APPLICATIONS

Certain subject matter that is disclosed in the present application is the subject of commonly owned, co-pending patent application of the same inventors, PENCIL IGNITION COIL ASSEMBLY MODULE, Ser. No., 09/392,047, filed Sep. 8,1999, and of commonly owned, co-pending patent application of inventor Todd C. Sexton, MECHANICAL LOCKING CONNECTION FOR ELECTRIC TERMINALS, Ser. No. 09/391,565, filed Sep. 8, 1999.

BACKGROUND OF THE INVENTION

1. Field of the Invention

This invention relates generally to internal combustion engine spark ignition systems, and more specifically to a pencil ignition coil assembly module that mounts directly on an engine in direct electric connection with an engine-mounted spark plug.

2. Background Information

Known internal combustion engines comprise cylinder blocks containing individual cylinders that are closed at one end by an engine cylinder head that is attached to the engine block. In a spark-ignition engine, the cylinder head contains threaded spark plugs holes, each of which is open to a respective cylinder. A respective spark plug is threaded into the respective hole to close the respective hole. External to the respective cylinder, each spark plug comprises a central electric terminal that is available for electric connection with a mating terminal of a secondary of the spark-ignition system.

Known spark ignition systems comprise what are sometimes called coil-on-plug type ignition coil assemblies. Each such assembly comprises both a wound primary coil and a wound secondary coil. At the proper time in the engine operating cycle for firing a particular spark plug, electric current flowing through the primary of the respective ignition coil assembly is abruptly interrupted to induce a voltage in the secondary coil sufficiently high to create a spark across gapped electrodes of the spark plug that are disposed within combustion chamber space of the respective engine cylinder, igniting a combustible fuel-air mixture to power the engine.

Examples of coil-on-plug type ignition coils are found in U.S. Pat. Nos. 4,514,712; 5,128,646; 5,590,637; and 5,870,012; as well as in U.K. Patent Application GB 2,199,193A. A common characteristic of such coils is that the primary and secondary coils are disposed one within the other, concentric with a common axis that is coincident with the axis of the spark plug electrode. The coils may be bobbin-mounted and encapsulated. Each of U.S. Pat. Nos. 5,128,646; 5,870,012; and U.K. Patent Application GB 2,199,193A shows the wound primary coil disposed interiorly of the secondary winding while the other two show the reverse. Various arrangements for providing electric circuit continuity of the secondary coil to the spark plug terminal are shown.

In certain engines, the threaded spark plug mounting hole may be at the bottom of a bore, or well, that extends inward from an outer surface of a cylinder head. For any of various reasons, such bores may be relatively long and narrow. It is for such bores that pencil ignition coil assembly modules are especially suited. U.S. Pat. No. 5,870,012 shows an example of a relatively long and narrow ignition coil assembly that is inserted for a majority of its length within a bore leading to a spark plug mounting hole. At its upper end, that ignition coil assembly has a connector disposed external to the bore and containing electric terminals providing for connection of the primary coil with the ignition system. An advantage of a pencil-type ignition coil is that when it is installed on an engine, the wiring that runs to it from a signal source need carry only primary coil current, because the entire secondary coil is contained within the module and is for the most part sheltered within the bore.

For proper ignition system performance, primary and secondary coils of an ignition coil assembly must be sized to reliably deliver a secondary voltage sufficiently large to spark the plug. The primary and secondary coils are typically encased in respective encapsulations which must possess physical characteristics suitable for providing protection both for the harsh ambient environment where the ignition coil is located and for the voltages generated. Because of dimensional constraints that may be imposed on a pencil-type ignition coil by the design of an engine, it is believed that an ignition coil possessing an ability to achieve specified performance criteria within confined space would be valuable to an engine manufacturer.

SUMMARY OF THE INVENTION

The present invention relates to a pencil ignition coil assembly module that possesses an organization and arrangement of elements believed to render it well suited for meeting specified performance criteria within the confines of limited space. Moreover, it is believed that the inventive module is well suited for reliable and cost-effective mass production, thereby making it especially attractive for use in automotive vehicle internal combustion engines.

One general aspect of the invention relates to an ignition coil assembly module that comprises: a primary bobbin containing an encapsulated primary coil, a secondary bobbin containing an encapsulated secondary coil, wherein the two bobbins are disposed on a common centerline, one interiorly of the other, a ferromagnetic shell which is also disposed on the centerline and within which both bobbins and coils are disposed, and an environmental shield encapsulating the shell.

Another general aspect relates to an ignition coil assembly module comprising: a secondary bobbin on which a secondary coil is disposed; a primary bobbin on which a primary coil is disposed; a ferromagnetic shell; the bobbins being disposed on a common centerline, one radially interiorly of the other, and the ferromagnetic shell being disposed in radially surrounding relationship to the other bobbin; and an environmental shield comprising a first tubular wall that encapsulates one of the coils on its bobbin and a second tubular wall that encapsulates one of the ferromagnetic shell and the other of the coils.

Another general aspect relates to a method of making an ignition coil assembly module comprising: providing a secondary bobbin on which a secondary coil is disposed; providing a primary bobbin on which a primary coil is disposed; providing a ferromagnetic shell; disposing the bobbins on a common centerline, one radially interiorly of the other, and disposing the ferromagnetic shell in radially surrounding relationship to the other bobbin; and creating an environmental shield comprising a first tubular wall that encapsulates one of the coils on its bobbin and a second tubular wall that encapsulates one of the ferromagnetic shell and the other of the coils.

Further aspects will be seen in the ensuing description, claims, and accompanying drawings.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT(S)

Figure 1:
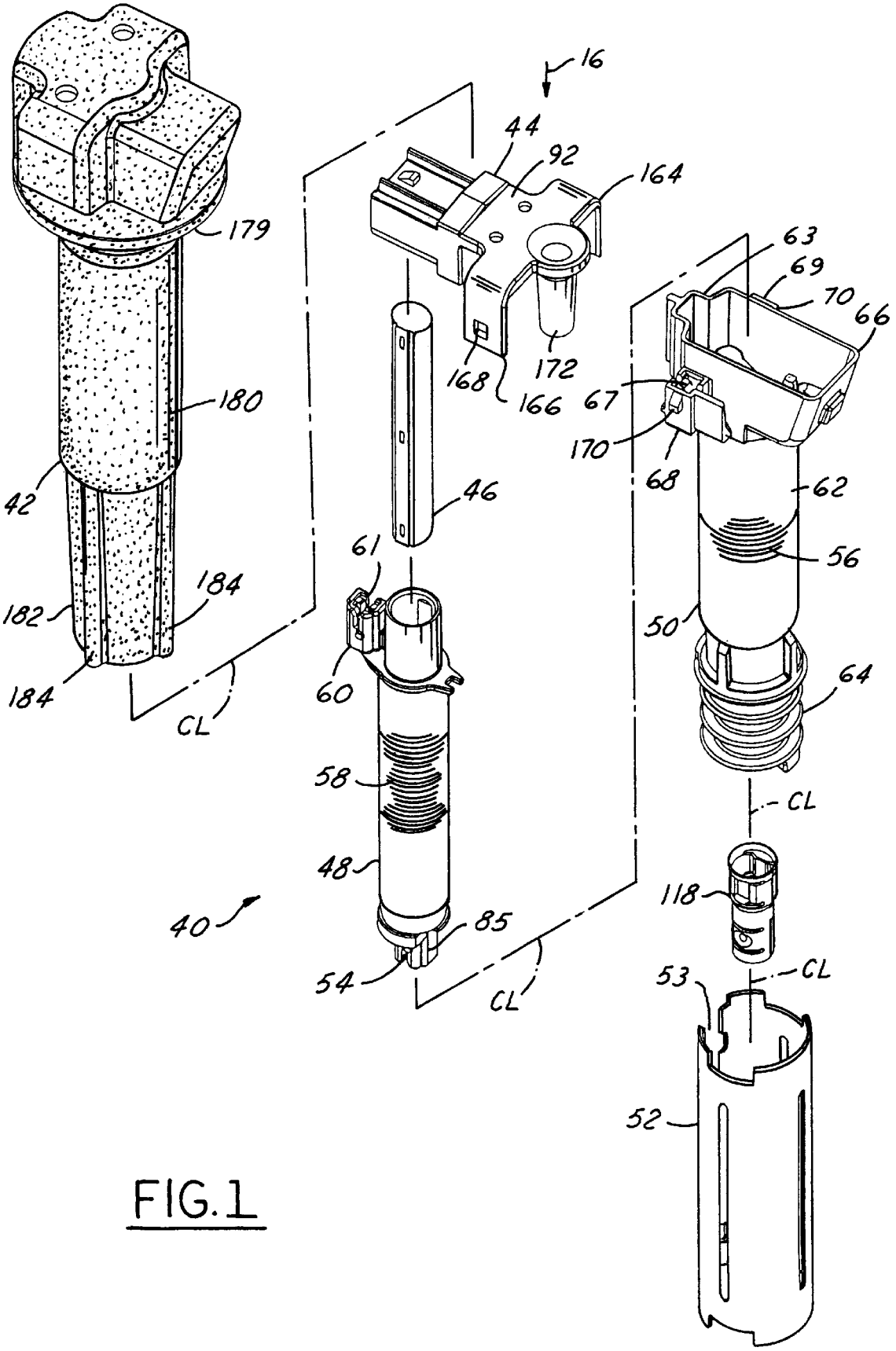
FIG. 1 is an exploded perspective view of a pencil ignition coil assembly module embodying principles of the present invention.
Figure 5:
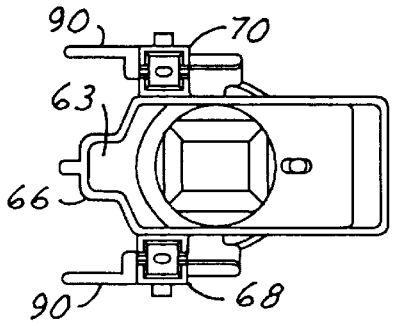
FIG. 5 is a top view of FIG. 2.
Figure 3:
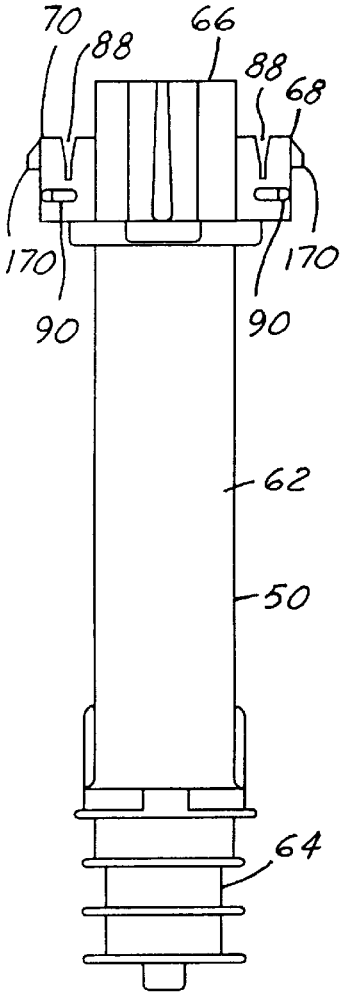
FIG. 3 is a left side elevation view of FIG. 2.
Figure 2:
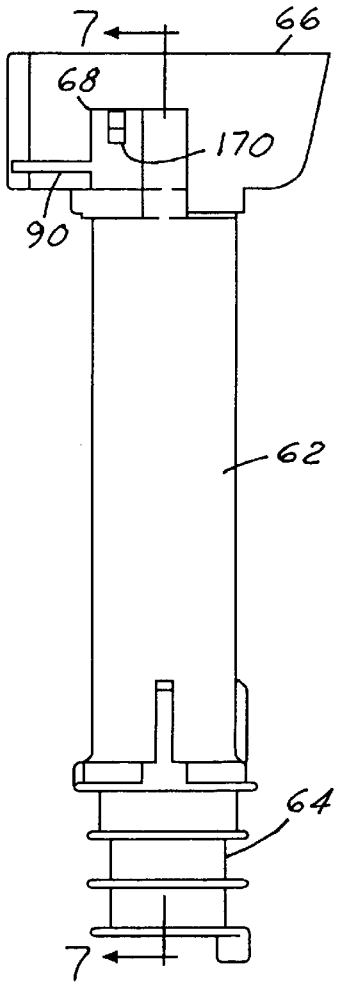
FIG. 2 is a front elevation view of one element of the module of FIG. 1 by itself, namely a primary bobbin.
Figure 4:
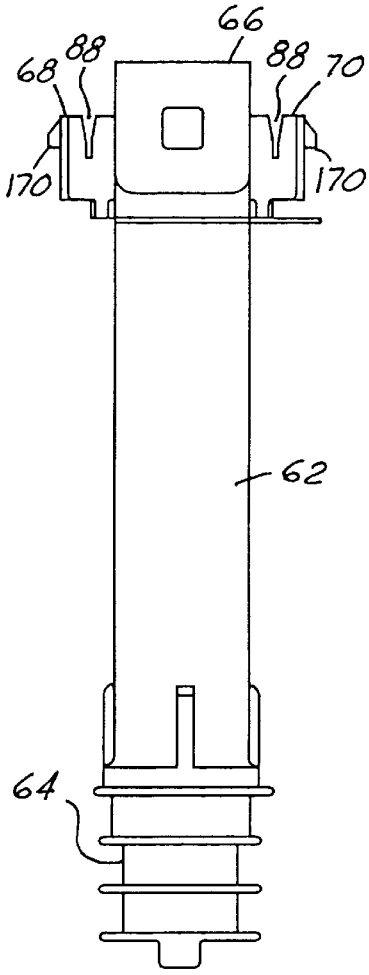
FIG. 4 is a right side elevation view of FIG. 2.
Figure 6:
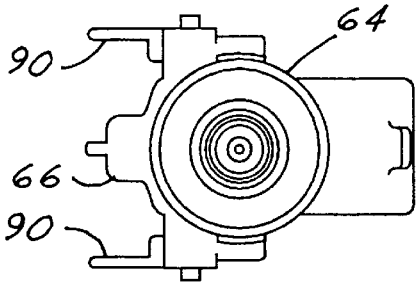
FIG. 6 is a bottom view of FIG. 2.
Figure 7:
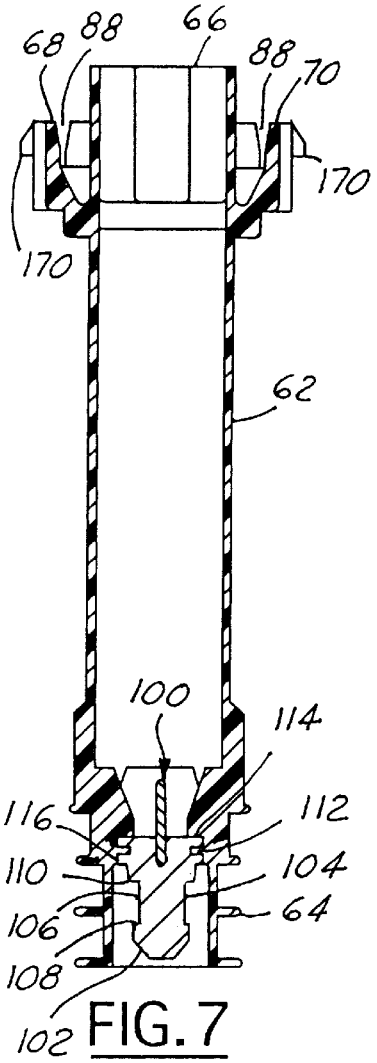
FIG. 7 is a cross section view in the direction of arrows 7—7 in FIG. 2.
Figure 11:
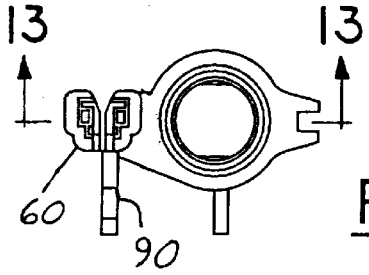
FIG. 11 is a top view of FIG. 8.
Figure 8:
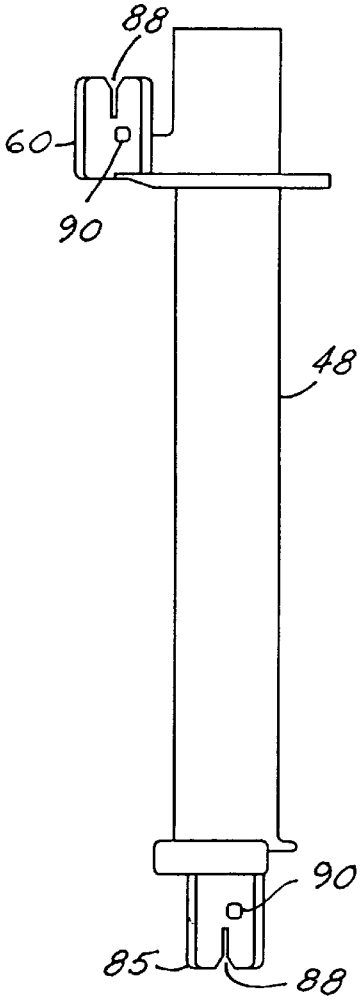
FIG. 8 is a front elevation view of another element of the module of FIG. 1 by itself, namely a secondary bobbin.
Figure 9:
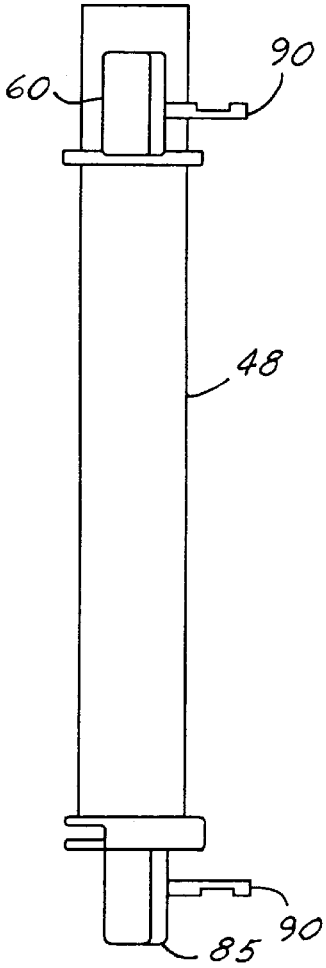
FIG. 9 is a left side elevation view of FIG. 8.
Figure 12:
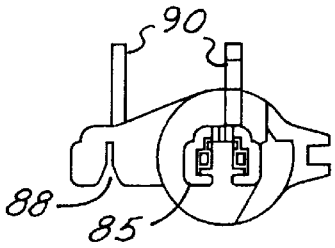
FIG. 12 is a bottom view of FIG. 8.
Figure 10:
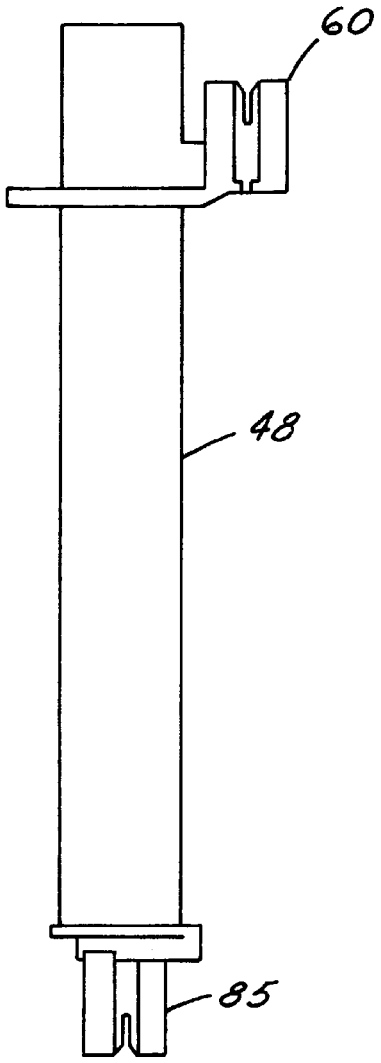
FIG. 10 is a rear elevation view of FIG. 8.
Figure 13:
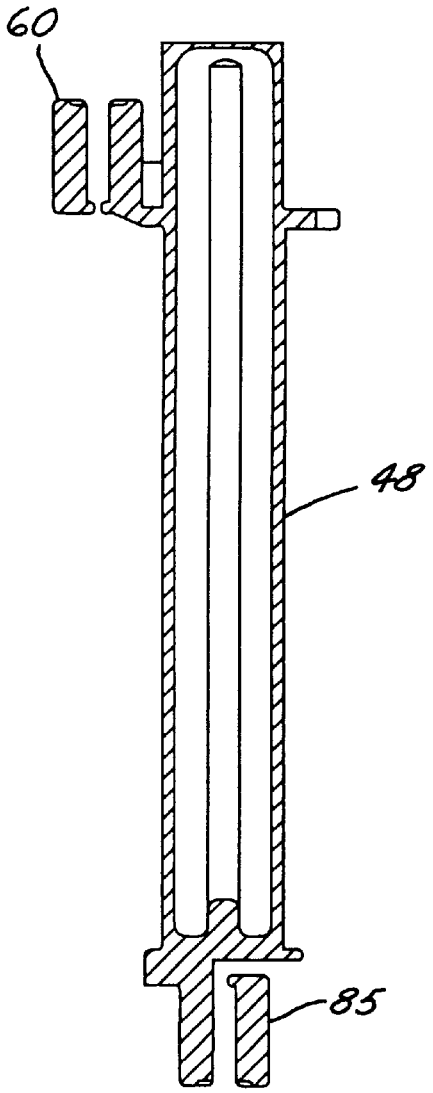
FIG. 13 is a cross section view in the direction of arrows 13—13 in FIG. 11.
Figure 14:
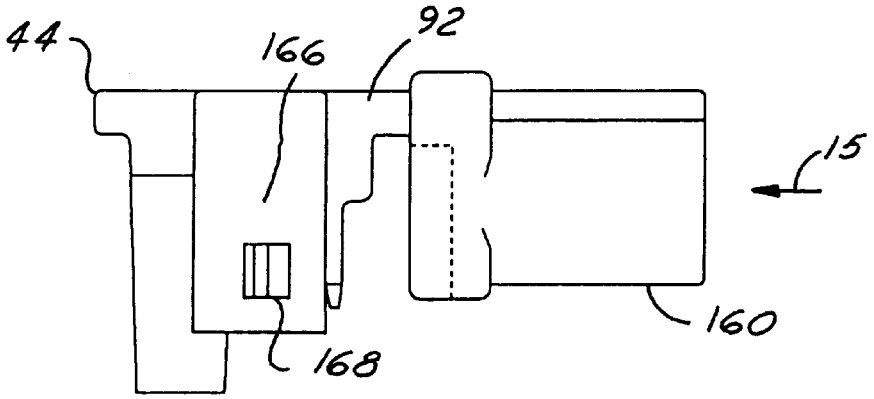
FIG. 14 is a rear elevation view of another element of the module of FIG. 1 by itself, namely a connector.
Figure 15:
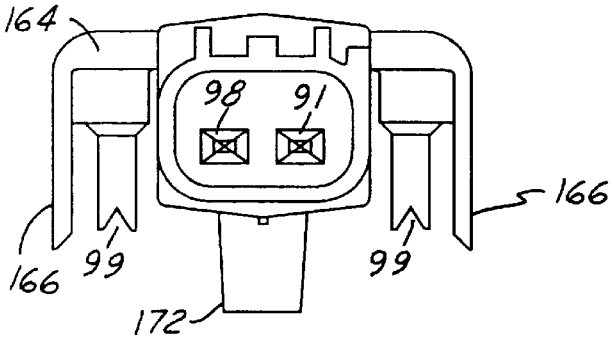
FIG. 15 is a side elevation view in the direction of arrow 15 in FIG. 14.
Figure 16:
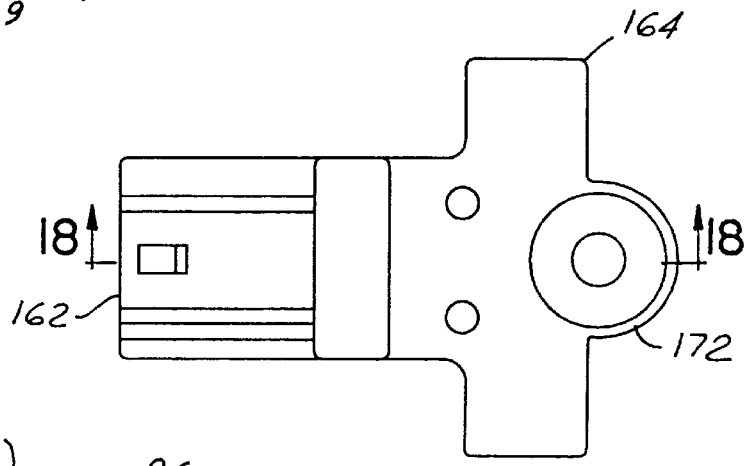
FIG. 16 is a top view of the connector in the direction of arrow 16 in FIG. 1.
Figure 17:
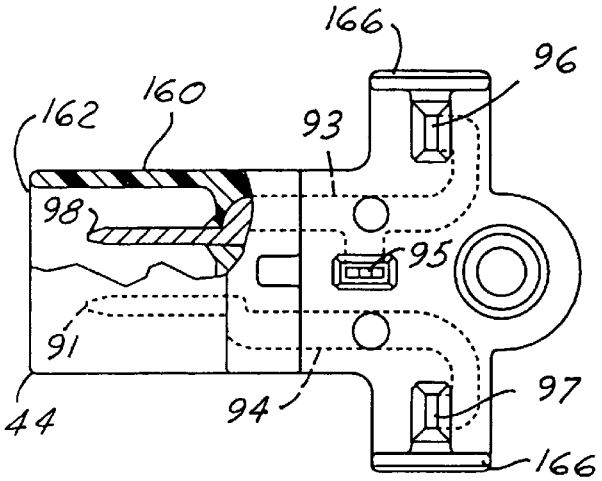
FIG. 17 is a bottom view of the connector with a portion broken away for illustration.
Figure 18:
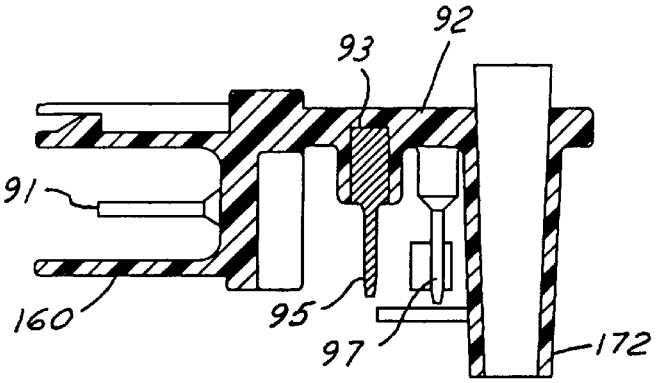
FIG. 18 is a cross section view in the direction of arrows 18—18 in FIG. 16.
Figure 23:
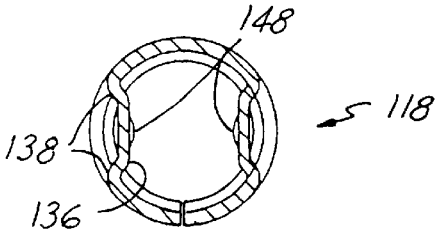
FIG. 23 is a cross section view in the direction of arrows 23—23 in FIG. 21.
Figure 19:
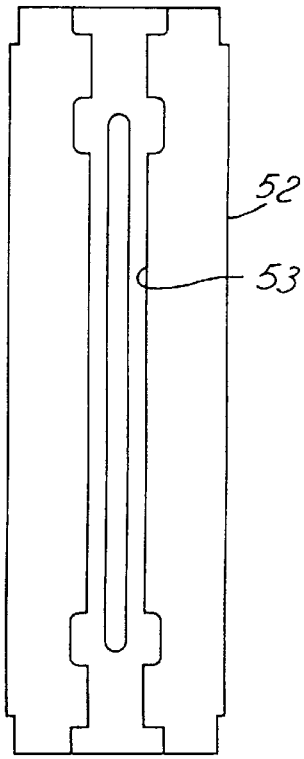
FIG. 19 is a left side elevation view of another element of the module of FIG. 1 by itself, namely a lamination assembly.
Figure 21:
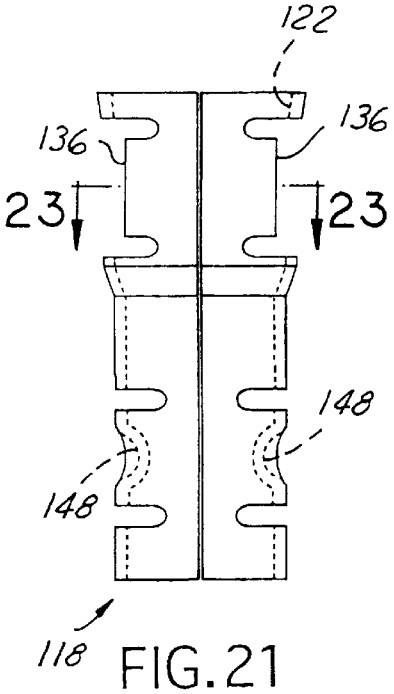
FIG. 21 is a left side elevation view of FIG. 20.
Figure 20:
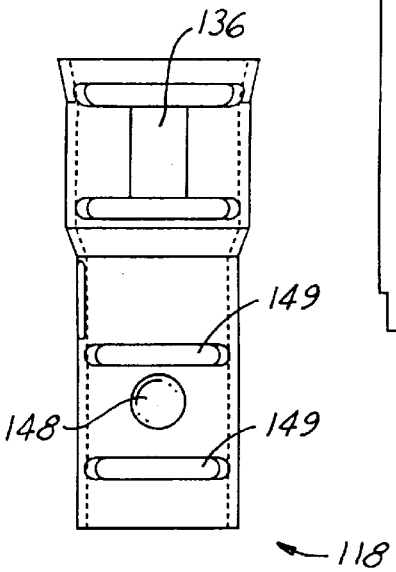
FIG. 20 is a front elevation view of another element of the module of FIG. 1 by itself, namely an ignition terminal.
Figure 22:
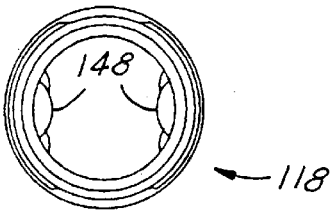
FIG. 22 is a bottom view of FIG. 21.
Figure 24:
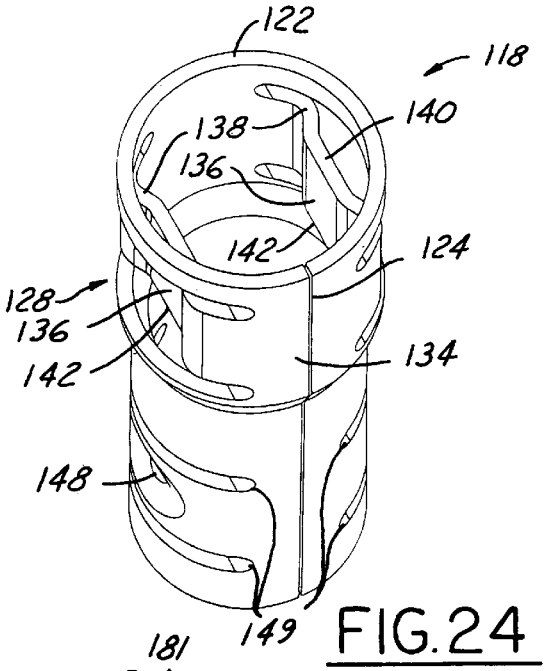
FIG. 24 is a perspective view of the ignition terminal looking from one direction.
Figure 25:
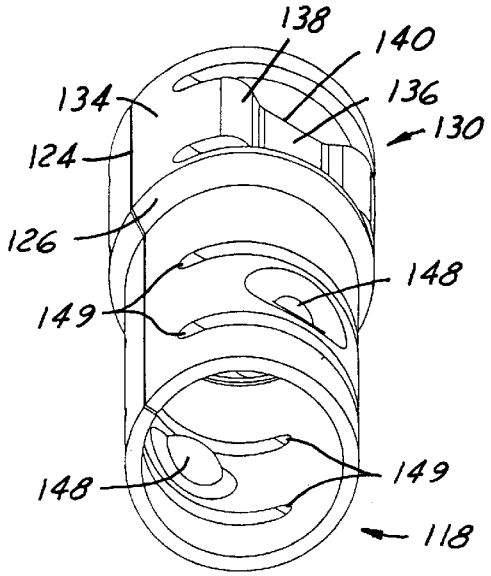
FIG. 25 is a perspective view of the ignition terminal looking from another direction.
Figure 26:
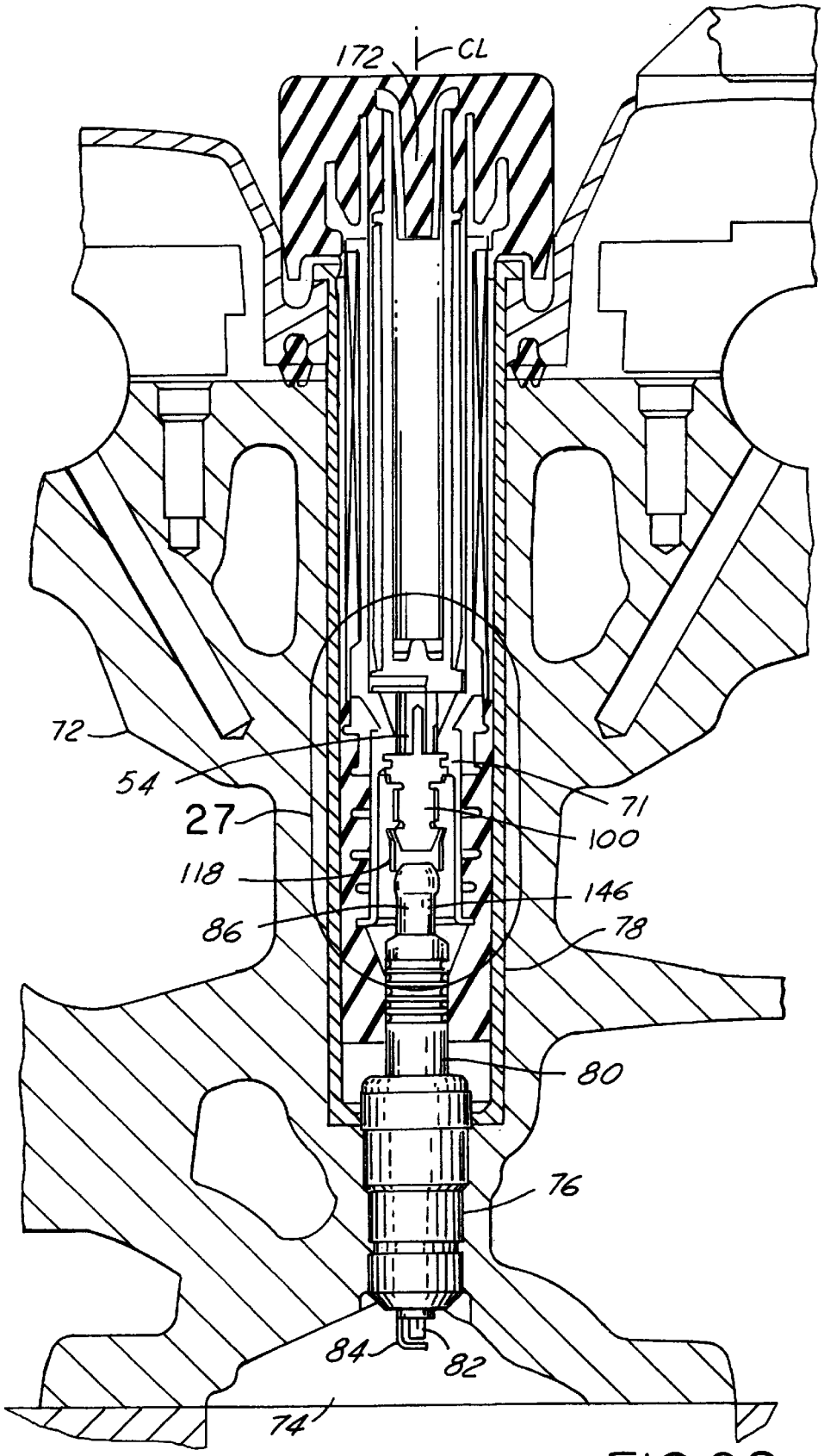
FIG. 26 is a vertical cross section view through a portion of an engine showing an installed pencil ignition coil assembly module.

FIGS. 1 and 26 show the general organization and arrangement of an example of a pencil ignition coil assembly module 40 embodying principles of the present invention. Module 40 has an imaginary centerline CL, and for convenience in the following description of the orientation of certain module components along centerline CL, reference will on occasion be made to proximal and distal directions. FIG. 1 shows several module components, including an environmental shield 42, a connector assembly 44, a ferromagnetic stacked lamination core 46, a secondary bobbin 48, a primary bobbin 50, several electric terminals 54, 61, 67, 69, 118, a primary coil 56, a secondary coil 58, and a ferromagnetic lamination assembly, or shell, 52. FIG. 26 shows the aforementioned components and at least one additional component that can't be seen in the view of FIG. 1, specifically another electric terminal 100.

Primary coil 56 is disposed around the outside of primary bobbin 50, and secondary coil 58, around the outside of secondary bobbin 48. Secondary bobbin 48 is disposed within the hollow interior of primary bobbin 50, and core 46 is disposed within the hollow interior of secondary bobbin 48. Core 46 comprises a stack of individual ferromagnetic laminations that form a generally cylindrical shape. Certain details of secondary bobbin 48 are disclosed in FIGS. 8–13, and of primary bobbin 50, in FIGS. 2–7. Lamination assembly 52 comprises ferromagnetic laminations disposed face-to-face and rolled in a generally tubular shape with a gap 53 that provides a circumferential discontinuity.

FIG. 26 shows a cylinder head 72 of an engine that comprises multiple cylinders 74, such as the one illustrated. Head 72 comprises a threaded spark plug hole 76 at the bottom of a bore, or well, 78. A spark plug 80 is threaded into hole 76 to dispose gapped electrodes 82, 84 within cylinder 74. A central electric terminal 86 of spark plug 80 remains external to cylinder 74 within well 78. Module 40 mounts on spark plug 80, with the distal end of terminal 118 mating with terminal 86. As will be more fully explained later, this connects one termination of secondary coil 58 to terminal 86 and hence to one of the electrodes 82, 84. The other electrode 82, 84 is grounded through the fastening of spark plug 80 to head 72. The module centerline CL with which the centerlines of both bobbins are coincident is coincident with centerlines of hole 76 and well 78.

Terminal 54 is disposed in a socket 85 that is formed centrally at the distal end of secondary bobbin 48. One termination of the wire that forms secondary coil 58 has electric continuity with terminal 54. At the opposite axial end of secondary bobbin 48, an opposite termination of the wire that forms secondary coil 58 has electric continuity with electric terminal 61 which is disposed in a generally rectangular socket 60 that is offset from centerline CL. (See FIG. 1.)

An axially intermediate portion of primary bobbin 50 comprises a circular cylindrical tubular wall 62 on which primary coil 56 is disposed. At its distal end, bobbin 50 comprises a tubular walled terminal shield 64, and at its proximal end, a hollow, generally rectangular-walled bowl 66 that is open to the hollow interior of tubular wall 62. Respective sockets 68, 70, similar in shape to socket 60, are disposed on the exterior of opposite side walls of bowl 66, and opposite terminations of the wire that forms primary coil 56 have electric continuity to respective electric terminals 67, 69 disposed in the respective sockets 68, 70. Terminal 100 is contained in a transverse wall 71 of primary bobbin 50. (See FIGS. 7 and 26.) Wall 71 is located in bobbin 50 approximately at the junction of the proximal end of shield 64 and the distal end of wall 62. To the proximal side of wall 71, a proximal portion of terminal 100 mates with terminal 54. To the distal side of wall 71, terminal 118 is assembled to a proximal portion of terminal 100, where the two are circumferentially surrounded by shield 64.

Each coil 56, 58 is fabricated from a respective known wire that comprises an electrically conductive core covered by a thin layer of insulation. Each coil 56, 58 is wound from a respective wire on its respective bobbin 50, 48 by known coil winding equipment and methods. The process for winding primary coil 56 includes drawing end segments of the primary coil wire through sockets 68, 70, particularly drawing them through slots 88 in the opposite socket walls (see FIGS. 4, 5, and 7) so that each wire segment spans the respective socket under tension. Proximate each socket 68, 70, bobbin 50 comprises a respective tie-off post 90 around which the respective wire end is wrapped after leaving the socket. The tie-off of each wire end around the respective post 90 secures the wire in tension across the interior of the respective socket at a level above the bottom of the socket. Terminals 67, 69 are then inserted into the respective sockets 68, 70, to secure and establish electric continuity with the wire end segments in the process. Thereafter, each wire is severed at a location between the respective socket and the respective tie-off post, the tie-off posts severed from the bobbin, and the severed portions discarded.

Secondary bobbin 48 also has tie-off posts 90 proximate sockets 60, 85. The wire end segments of secondary coil 58 are associated with sockets 60, 58, and terminals 61, 54 associated with the wire end segments, in a somewhat similar manner to that just described for the primary bobbin sockets and primary coil wire end segments, with the tied-off wire ends and tie-off posts eventually being severed and discarded.

Terminals 54, 61, 67, 69 are insulation displacement type terminals (sometimes called an insulation displacement connector, or IDC). Each of the IDC's that connects to a respective end segment of the secondary coil wire has a shape that changes slightly as it is being pushed into the open end of the respective socket. This causes the IDC to become wedged in the socket. When it has been fully inserted into a socket, the IDC clamps the secondary coil wire against the bottom wall of the socket. The portion that clamps the secondary wire contains serrations that cut through an outer insulation layer of the wire to make effective electric contact with the bare metal conductor of the wire.

The primary coil wire has a larger diameter than that of the secondary. IDC's for the primary coil wire are somewhat different. The primary wire segments are suspended in tension across the sockets at a level above the socket bottoms. The IDC's have precision slots that slice into sides of the suspended primary wire segments as the IDC's are being inserted into the sockets. The slot edges cut through outer insulation layers to establish electric continuity with the underlying metal conductors.

FIGS. 14–18 show connector assembly 44 to comprise a body 92 of electrically non-conductive material that contains two separate electric conductors 93, 94. Conductor 93 comprises two electric terminals 95, 96, and conductor 94 comprises an electric terminal 97. Terminals 95, 96, 97 are arranged in a geometric pattern matching that of sockets 60, 68, 70. Each terminal 95, 96, 97 is a blade type terminal having a downwardly open notch 99.

Figure 28:
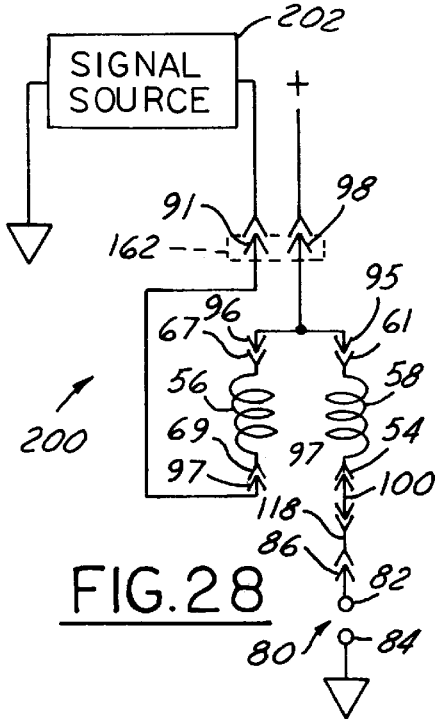
FIG. 28 is a schematic electric circuit diagram of the pencil ignition coil assembly module.

Conductor 93 comprises a further terminal 98, and conductor 94, a further terminal 91 that are arranged parallel and side-by-side in spaced relation to terminals 95, 96, 97. Whereas the latter three terminals point in a direction that is parallel with centerline CL, terminals 98, 91 point in a direction that is transverse to centerline CL. Exposed portions of terminals 98, 91 are bounded by a surround 160 of body 92 thereby forming an electric connector 162 to which a mating connector (see FIG. 28) can be attached to connect module 40 with a signal source for firing spark plug 80. FIG. 28, to be described later, schematically depicts the electric circuit connection.

Connector body 92 comprises a bridge 164 (see FIG. 1) that straddles the proximal end of bobbin 50 across sockets 68, 70. Opposite ends of bridge 164 comprise tabs 166 each containing a respective non-circular hole 168. As connector assembly 44 is being attached to bobbins 48, 50 by properly aligning the connector assembly with proximal ends of the bobbins and advancing it toward the bobbins distally along centerline CL, tabs 166 ride over catches 170 on the outer walls of sockets 68, 70, slightly flexing bridge 164. As the attachment is being completed, holes 168 come into registration with catches 170, and the flexed bridge 164 relaxes, causing catches 170 to lodge in holes 168, thereby locking connector assembly 44 to primary bobbin 50. Connector body 92 further comprises a core locator 172 that fits into the open end of secondary bobbin 48 and protrudes into the interior of the secondary bobbin substantially to the proximal end of core 46 thereby keeping the core in place.

As connector assembly 44 is being attached to bobbins 48, 50, terminal 95 mates with secondary terminal 61, and terminals 96, 97 mate with primary terminals 69, 67 respectively. In this way, conductor 93 places respective terminations of both coils in common with terminal 98, and conductor 94 places an opposite termination of primary coil 56 in common with terminal 91.

Primary bobbin 50 is fabricated by molding of a suitable polymeric (plastic) material, and during the fabrication process, transverse wall 71 is formed around terminal 100. Terminal 100 is a machined metal part. It comprises a medial portion around which the primary bobbin transverse wall is molded and a distal end portion that is circumferentially bounded by terminal shield 64. The distal end portion of terminal 100 comprises a convex frustoconical lead 102 and a circular, cylindrical groove 104 that is proximal to lead 102. Groove 104 comprises an internal circular cylindrical face 106 bounded distally by a distal shoulder 108 and proximally by a proximal shoulder 110. Each shoulder is at a right angle to centerline CL. Where it closes what would otherwise be an open through-hole in transverse wall 71, terminal 100 comprises a circular groove 112 axially separating circular flanges 114, 116, and the bobbin material forms around these features during the process of molding it to unite the two parts in sealed relationship.

FIGS. 20–25 show detail of electric terminal 118. Terminal 118 comprises a cylindrical walled tube having a distal end portion comprising an open distal end 120 and a proximal end portion comprising an open proximal end 122, which may have a slight lead as illustrated. The tube is fabricated by a roll-forming fabrication method from electrically conductive metal strip. A split line 124 at which edges of the rolled metal meet, either coming together or leaving a small gap between them, runs axially between the open ends 120, 122. Connection of terminal 118 to terminal 100 is accomplished by axially aligning lead 102 of the latter with the open proximal end 122 of the tubular terminal 118 and advancing the two terminals together.

The tube wall comprises a first formation 126 that is complementary to, and immediately confronts, lead 102 of terminal 100 when the two terminals 100, 118 have been connected together. Formation 126 comprises a concave frustoconical formation of the tube wall. Proximal to formation 126, the tube wall comprises a second formation 128 which comprises two bridges 130, 132 lanced radially inward from a nominally circular cylindrical section 134 of the tube wall, diametrically opposite one another. Each bridge comprises a respective central span 136 whose opposite ends join with section 134 via curved bends 138. The two central spans 136 are disposed substantially parallel at a nominal spacing distance from each other.

That nominal spacing distance is equal to a diameter across the convex surface of lead 102 of terminal 100 such that as the two terminals 100, 118 are being connected, proximal edges 140 of spans 136 will be disposed in interference to the advancing lead 102. Bridges 130, 132 are resiliently deflectable such that continued advancement of terminal 100 into connection with terminal 118 will cause lead 102 to flex bridges 130, 132 radially outward, spreading them apart as the lead passes between them. Connection of terminals 100, 118 to each other is completed once groove 104 attains registration with the spread apart bridges. The axial dimension of groove 104 as measured between shoulders 108, 110 is slightly greater than the axial dimension of the bridges, allowing the bridges to relax from their spread apart condition and enter the groove. The diameter of internal face 106 is greater than the nominal spacing distance between spans 136, and so the spans will bear tangentially against face 106 to provide electric contact between the terminals. At the same time, distal edges 142 of bridges 130, 132 are in interference with the distal shoulder 108 of groove 104, thereby preventing the connected terminals from disconnecting in response to axial forces attempting to disconnect them.

Because of the shielding of terminal 100 by terminal shield 64, and because of the relatively small dimensions characteristic of parts of this nature, tool access for joining the two terminals 100, 118 by processes such as soldering or fusing is rather poor. The inventive connection, which does not rely on such processes, enables the two terminals to be connected together with sufficient surface contact area for efficiently conducting the electric current magnitudes that typically characterize secondary current in an ignition coil, and to remain so connected even when subjected to axial forces tending to disconnect them. The attachment is also resistant to radial forces because lead 102 in essence seats on concave formation 126.

Distal to formation 126, terminal 118 comprises essentially a tubular wall. That wall contains hemispherically rounded dimples 148 that protrude radially inward diametrically opposite each other. When ignition coil assembly module 40, including terminal 118, is assembled to the engine, the open distal end of terminal 118 fits over the exposed end of spark plug terminal 86. Dimples 148 protrude inward sufficiently to abut terminal 86 as the latter enters terminal 118, causing slight circumferential expansion of the tubular terminal wall. Spark plug terminal 86 has a groove 146 around the outside. Dimples 148 are located in terminal 118 along centerline CL such that when they arrive at groove 146, the expanded tubular wall of terminal 118 relaxes slightly so as to forcefully lodge dimples 148 in groove 146 to make the electric connection to the spark plug. In other words, the construction of module terminal 118 in relation to spark plug terminal 86 is such that as module 40 is being assembled to the engine and the spark plug terminal enters terminal 118, engagement of the spark plug terminal by dimples 148 causes the tubular distal end of terminal 118 to circumferentially expand so that the spark plug terminal can more fully enter the distal end of terminal 118. Once the spark plug groove attains registration with the dimples, the tubular wall relaxes slightly, causing the dimples to forcefully grip the spark plug groove and establish the electric connection. Spark plug groove 146, unlike groove 106, has rounded shoulders that allow repeated connection and disconnection of module 40 to and from spark plug 80. Whenever tool access to spark plug 80 is desired, module 40 can be pulled out of bore 78, causing terminal 118 to disengage from spark plug terminal 86 while terminals 100 and 118 remain securely attached together. The tubular wall of terminal 118 that contains dimples 148 also contains two pairs of circumferentially arcuate through-slots 149, one of each pair being proximal to a respective dimple and the other of each pair being distal to the respective dimple.

Environmental shield 42 forms an enclosure of module 40. It encloses all of connector assembly 44 except for electric connector 162 so that a mating wiring harness connector can be connected to module 40. A portion of shield 42 forms a closure 179 that fills space that would otherwise be open at the proximal end of the module between connector assembly 44 and primary and secondary bobbins 50, 48. Before environmental shield 42 is fabricated, lamination assembly 52 is placed over primary bobbin 50 and coil 56. Coil 56 has radial clearance to lamination assembly 52 around its full circumference. Shield 42 comprises an imperforate outer tubular wall 180 that extends distally from closure 179 to enclose lamination assembly 52 on the exterior of primary bobbin wall 62, filling the various slots and notches in the lamination assembly, including gap 53. Shield 42 further comprises an inner tubular wall 181 that extends distally from closure 179 to fill the annular clearance space between lamination assembly 52 and coil 56, thereby encapsulating the primary coil on the primary bobbin. Outer wall 180 extends still further to an open distal end that not only surrounds terminal shield 64, but extends distally beyond primary bobbin 50 to form a boot 182 for fitting over spark plug 80 when module 40 is installed on the engine.

FIG. 1 shows that boot 182 has a somewhat tapered tubular shape with several fins 184 running lengthwise along the outside. While boot 182 has sufficient column strength to fit onto the spark plug during the process of installing module 40 on the engine, it also possesses some flexibility for assuring a proper fit. Should fins 184 rub against the bore wall as module 40 is being installed, they and the boot can flex slightly to varying degrees of alignment within dimensional tolerances.

Shield 42 has an association with bore 78 that essentially closes the bore to the outside ambient environment after module 40 has been installed on the engine. Near its proximal end, shield 42 comprises a circular overhang 186 that forms a circular groove 188 which runs around the outside of closure 179 and opens in the distal direction. A circular rim 190 on cylinder head 72 surrounds the open proximal end of bore 78, and when module 40 is installed, groove rim 190 fits into groove 188 and into contact with overhang 186 to seal the boot to the cylinder head, thereby closing the open end of the bore.

Because secondary bobbin 48 and its coil 58 are disposed within the hollow interior of primary bobbin 50, and because the hollow interior of primary bobbin 50 is closed, except for being open at its proximal end, primary bobbin 50 can function, during the process of fabricating module 40, as a liquid container for holding secondary coil encapsulant 194. It is preferred that secondary bobbin 48 and coil 58 be assembled into the hollow interior of primary bobbin 50 before secondary encapsulant 194 is introduced. Secondary bobbin 48 is assembled to primary bobbin 50 by inserting the distal end of the former into the open proximal end of the latter through bowl 66, and advancing the secondary bobbin to cause terminal 54 to engage the proximal end of terminal 100. At the same time, socket 60 locates in an alcove 63 at a side wall of the bowl. Sufficient radial clearance is provided between secondary coil 58 and the interior surface of primary bobbin wall 62 to allow for an appropriate secondary coil encapsulant 194, such as epoxy or oil to be introduced in liquid form into bowl 66 and flow distally into the interior of primary bobbin 50 and fill annular space surrounding secondary bobbin 48 and secondary coil 58 to a level sufficient to fully cover the latter. The fill level may extend into bowl 66 to where the termination of the secondary coil wire connects to electric terminal 61.

Subsequently, environmental shield 42 is fabricated by the injection molding of suitable material, such as silicone rubber, onto the assembled bobbins in a suitably constructed mold. After having been injected, the material is allowed to cure, creating the final shape for environmental shield 42 that has been described above.

Figure 27:
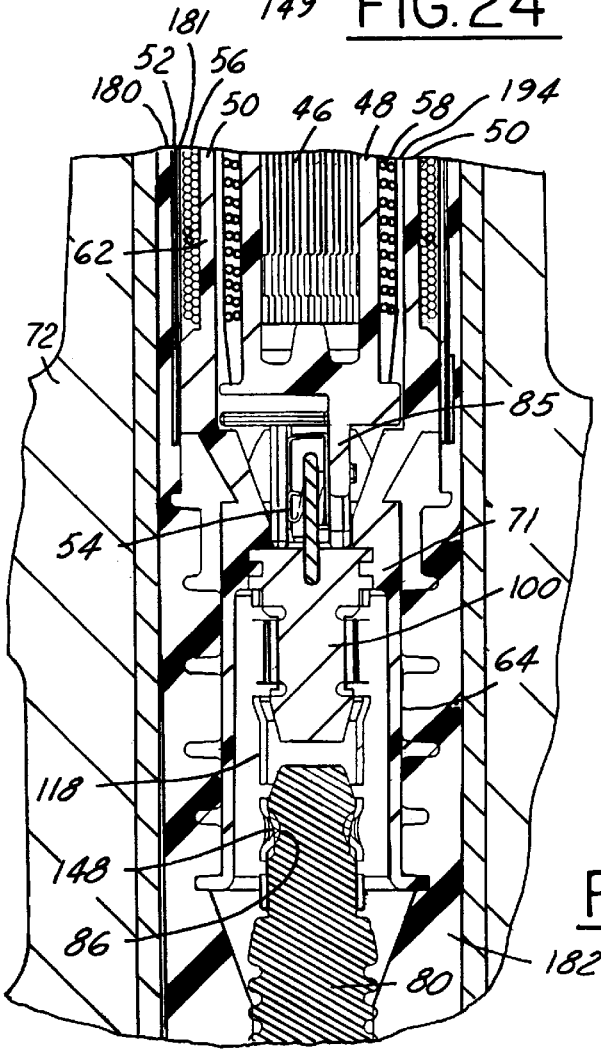
FIG. 27 is an enlarged view in circle 27 of FIG. 26.

FIG. 27 shows that the construction of module 40 that has been described results in what may be considered a succession of cylindrical layers about a central ferromagnetic core, the central ferromagnetic core being the stacked lamination core 46. Such cylindrical layers are, from innermost to outermost: secondary bobbin 48; secondary coil 58; secondary encapsulant 194; primary bobbin 50; primary coil 56; inner wall 181 of environmental shield 42 encapsulating primary coil 56; lamination assembly 52; and outer wall 180 of environmental shield 42 encapsulating lamination assembly 52.

The use of primary bobbin 50 as a container for encapsulant 194 to encapsulate secondary coil 58, and the use of environmental shield 42 as an encapsulant of primary coil 56, an encapsulant of lamination assembly 52, and an encapsulant of connector assembly 44, to enclose the proximal end of module 40 where connector assembly 44 attaches to primary and secondary bobbins 50, 48, and to form boot 182 are believed novel and especially advantageous features that can provide important efficiencies in compactness of ignition coil assembly modules and in manufacturing and assembly cost effectiveness.

FIG. 28 shows how module 40 is operatively connected with an electric ignition circuit 200 for firing spark plug 80. Circuit 200 comprises a signal source 202 between ground and terminal 91. Terminal 98 is connected to a suitable primary potential relative to ground. Spark plug electrode 84 is connected to ground, and electrode 82 is connected through terminals 118, 100, 54 to secondary coil 58.

When signal source 202 is in a low impedance state, primary current is established in primary coil 56. At proper time for firing spark plug 80, signal source 202 switches to a high impedance state. Current in primary coil 56 is suddenly interrupted, causing a magnetic field coupling the primary and secondary coils to collapse, and thus inducing secondary voltage in secondary coil 58 sufficient to fire spark plug 80.

Certain principles of the invention contemplate that instead of encapsulating the secondary coil as described above, it can be encapsulated by injecting over it a liquid material that is then allowed to cure, silicone rubber for example. By encapsulating the secondary coil in this manner as the environmental shield is being molded, a beneficial manufacturing synergy may be obtained.

Certain aspects of the invention do not necessarily require that the environmental shield material also encapsulate the ferromagnetic shell; for example, encapsulating an E-coated (electro-coated) shell may be unnecessary. Where a module has an E-coated shell that does not require encapsulation, the environmental shield may be molded in a manner that does not encapsulate the shell, in which case the resulting environmental shield may cease to be a single unitary element of the module, and instead appear as multiple elements. For example, a single molding operation may form spark plug boot 182 as one separate element of the environmental shield, and closure 179 and the covering of connector assembly 44 as another separate element.

While a presently preferred embodiment has been illustrated and described, it is to be appreciated that the invention may be practiced in various forms within the scope of the following claims.

What is claimed is:

1. An ignition coil assembly module that comprises:

a primary bobbin containing a primary coil, a secondary bobbin containing a secondary coil, wherein the two bobbins are disposed on a common centerline, one bobbin interiorly of the other bobbin, a ferromagnetic shell which is also disposed on the centerline and within which both bobbins and coils are disposed, and an environmental shield encapsulating the shell, and in which the shell is spaced radially from the other bobbin, and the environmental shield comprises a radially inner wall of solid encapsulating material between the other bobbin and the shell and encapsulating the coil contained on the other bobbin and a radially outer wall of solid encapsulating material surrounding the shell.

2. An ignition coil assembly module that comprises:

a primary bobbin containing an encapsulated primary coil, a secondary bobbin containing an encapsulated secondary coil, wherein the two bobbins are disposed on a common centerline, one interiorly of the other, a ferromagnetic shell which is also disposed on the centerline and within which both bobbins and coils are disposed, and an environmental shield encapsulating the shell,in which the environmental shield further comprises a tubular wall that extends axially in one direction along the centerline beyond the bobbins to form a boot for fitting to an engine spark plug.

3. An ignition coil assembly module as set forth in claim 2 further including a connector assembly at an axial end of the bobbins making electric connections to the primary and secondary coils, and in which the environmental shield comprises an enclosure that closes the connector assembly to the bobbins.

4. An ignition coil assembly module that comprises:

a primary bobbin containing a primary coil, a secondary bobbin containing a secondary coil, wherein the two bobbins are disposed on a common centerline, one bobbin interiorly of the other bobbin, a ferromagnetic shell which is also disposed on the centerline and within which both bobbins and coils are disposed, and an environmental shield encapsulating the shell, and wherein the primary bobbin, the primary coil, the secondary bobbin, the secondary coil, the ferromagnetic shell, and the environmental shield are arranged as a succession of cylindrical layers about a ferromagnetic central core that comprises, from innermost to outermost, a) the secondary bobbin, b) the secondary coil, c) a radially inner wall of the environmental shield, d) the primary bobbin, e) the primary coil, f) a radially intermediate wall of the environmental shield, g) the shell, and h) a radially outer wall of the environmental shield, wherein the radially inner, radially intermediate, and radially outer walls of the environmental shield comprise solid encapsulating material.

5. An ignition coil assembly module that comprises:

a primary bobbin containing an encapsulated primary coil, a secondary bobbin containing an encapsulated secondary coil, wherein the two bobbins are disposed on a common centerline, one interiorly of the other, a ferromagnetic shell which is also disposed on the centerline and within which both bobbins and coils are disposed, and an environmental shield encaDsulating the shell, wherein the primary bobbin, the encapsulated primary coil, the secondary bobbin, the encapsulated secondary coil, the ferromagnetic shell, and the environmental shield are arranged as a succession of cylindrical layers about a ferromagnetic central core that comprises, from innermost to outermost, a) the secondary bobbin, b) the encapsulated secondary coil, c) the primary bobbin, d) the encapsulated primary coil, e) the shell, and f) the environmental shield, and the environmental shield comprises an inner cylindrical wall occupying radial clearance between the shell and the primary coil to encapsulate the primary coil, and an outer cylindrical wall encapsulating the shell; and further including a connector assembly disposed on the bobbins and comprising a body containing electric conductors making electric connections to the primary and secondary coils; and wherein the environmental shield further comprises an enclosure of the connector assembly to the bobbins that encloses the connections of the connector assembly to the coils.

6. An ignition coil assembly module that comprises:

a primary bobbin containing a primary coil, a secondary bobbin containing a secondary coil, wherein the two bobbins are disposed on a common centerline, one bobbin interiorly of the other bobbin, a ferromagnetic shell which is also disposed on the centerline and within which both bobbins and coils are disposed, and an environmental shield of solid encapsulating material encapsulating the shell, and in which the coil contained on the one bobbin and the coil contained on the other bobbin are encapsulated on their respective bobbins by respective walls of solid encapsulating material of the environmental shield.

7. An ignition coil assembly module as set forth in claim 6 in which the solid encapsulating material of the environmental shield comprises silicone rubber.

8. An ignition coil assembly module comprising:

a secondary bobbin on which a secondary coil is disposed;

a primary bobbin on which a primary coil is disposed;

a ferromagnetic shell;

the bobbins being disposed on a common centerline, one bobbin radially interiorly of the other bobbin, and the ferromagnetic shell being disposed in radially surrounding relationship to the other bobbin; and an environmental shield comprising a first tubular wall of solid encapsulating material that encapsulates one of the coils on its bobbin and a second tubular wall of solid encapsulating material that encapsulates one of the ferromagnetic shell and the other of the coils.

9. An ignition coil assembly module as set forth in claim 8 in which the environmental shield further comprises a third tubular wall of solid encapsulating material that encapsulates the other of the ferromagnetic shell and the other of the coils.

10. An ignition coil assembly module as set forth in claim 9 in which all three tubular walls comprise silicone rubber.

11. An ignition coil assembly module as set forth in claim 8 in which the environmental shield further comprises an axial extension of one of the tubular walls that extends axially beyond the bobbins and forms a spark plug boot.

12. An ignition coil assembly module as set forth in claim 8, including a connector assembly attached to a common axial end of the bobbins to make electric circuit connections to the primary and secondary coils, and in which the environmental shield further comprises an enclosure of the connector assembly to the bobbins that encloses the connections of the connector assembly to the coils.

13. A method of making an ignition coil assembly module comprising:

providing a secondary bobbin on which a secondary coil is disposed;

providing a primary bobbin on which a primary coil is disposed;

providing a ferromagnetic shell;

disposing the bobbins on a common centerline, one bobbin radially interiorly of the other bobbin, and disposing the ferromagnetic shell in radially surrounding relationship to the other bobbin; and creating an environmental shield comprising a first tubular wall of solid encapsulating material that encapsulates one of the coils on its bobbin and a second tubular wall of solid encapsulating material that encapsulates one of the ferromagnetic shell and the other of the coils.

14. A method as set forth in claim 13, in which the step of creating the environmental shield further comprises creating an environmental shield comprising a third tubular wall of solid encapsulating material that that encapsulates the other of the ferromagnetic shell and the other of the coils on its bobbin.

15. A method as set forth in claim 14, in which the step of creating the environmental shield comprises injection molding silicone rubber in a mold to cause all three tubular walls to comprise silicone rubber.

16. A method as set forth in claim 13, in which the step of creating the environmental shield further comprises creating a spark plug boot as an axial extension of one of the tubular walls that extends axially beyond the bobbins.

17. A method as set forth in claim 13, including the step of attaching a connector assembly to a common axial end of the bobbins to make electric circuit connections to the primary and secondary coils, and in which the step of creating the environmental shield further comprises creating an enclosure of the connector assembly to the bobbins that encloses the connections of the connector assembly to the coils.

* * * * *